US009377172B2

(12) United States Patent
Chabert et al.

(10) Patent No.: US 9,377,172 B2
(45) Date of Patent: Jun. 28, 2016

(54) LIGHTING BALLOON

(75) Inventors: Pierre Chabert, Saint Martin d'Heres (FR); Maxime Polese, Saint Martin d'Uriage (FR)

(73) Assignee: AIRSTAR, Le Champ-des-Pres-Froges (FR)

( * ) Notice: Subject to any disclaimer, the term of this patent is extended or adjusted under 35 U.S.C. 154(b) by 143 days.

(21) Appl. No.: 13/985,385

(22) PCT Filed: Feb. 13, 2012

(86) PCT No.: PCT/EP2012/052422
§ 371 (c)(1),
(2), (4) Date: Oct. 24, 2013

(87) PCT Pub. No.: WO2012/110460
PCT Pub. Date: Aug. 23, 2012

(65) Prior Publication Data

US 2014/0036512 A1 Feb. 6, 2014

(30) Foreign Application Priority Data

Feb. 14, 2011 (FR) ..... 11 51186

(51) Int. Cl.
*F21V 1/06* (2006.01)
*F21V 3/02* (2006.01)

(52) U.S. Cl.
CPC .. *F21V 1/06* (2013.01); *F21V 3/023* (2013.01)

(58) Field of Classification Search
CPC ..... A63H 27/10; A63H 2027/1058; A63H 2027/1033; A61B 1/00082; A61B 2017/00557; A61B 5/6853; A61B 2018/0022; A61M 25/10; A61M 25/1018; F21V 3/026; F21V 1/06; F21V 3/023; A61F 2/958
USPC ..... 600/116; 446/220; 604/96.01, 99.01; 244/31; 116/210; 428/12; 606/192
See application file for complete search history.

(56) References Cited

U.S. PATENT DOCUMENTS

| | | | | |
|---|---|---|---|---|
| 6,981,785 | B1 | 1/2006 | Watchulonis | |
| 2005/0185410 | A1 | 8/2005 | Liao et al. | |
| 2008/0067285 | A1 * | 3/2008 | Gobbi et al. | 244/33 |
| 2008/0158904 | A1 | 7/2008 | Lai | |

FOREIGN PATENT DOCUMENTS

| | | |
|---|---|---|
| DE | 20 768 | 1/1883 |
| DE | 20 2007 001380 | 5/2007 |

* cited by examiner

*Primary Examiner* — Stephen F Husar
*Assistant Examiner* — Danielle Allen
(74) *Attorney, Agent, or Firm* — Oblon, McClelland, Maier & Neustadt, L.L.P.

(57) ABSTRACT

A lighting balloon including a deformable envelope, at least one lighting mechanism mounted inside the envelope, and a supporting and stretching mechanism for the envelope, including a plate carrying the lighting mechanism and with a longitudinally extending distancing element mounted on the plate. The supporting and stretching mechanism cooperates with an apex and a base of the envelope to stretch the envelope in the longitudinal direction. The balloon further includes at least one shape-maintaining mechanism mounted on the envelope and arranged transversely in relation to the distancing element.

14 Claims, 9 Drawing Sheets

LIGHTING BALLOON

Figure 1:
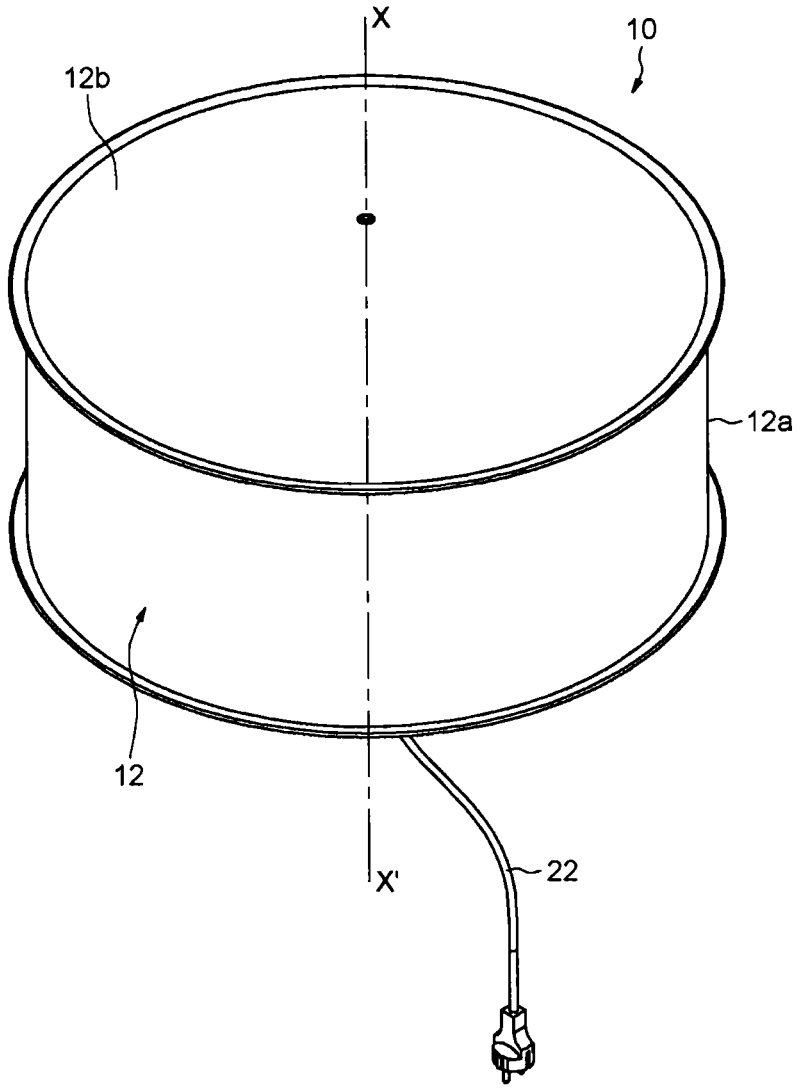

The present invention relates to the general field of lighting balloons.

Lighting balloons are generally used to obtain a uniform and glare-free light, for example during events for lighting a site or else when in a photo shoot.

Such balloons can also be used in heavy industry environments or construction sites.

For these applications, the lighting balloons conventionally used comprise an inflatable envelope enclosing electric light bulbs and a control block intended to supply electrical energy to the light bulbs and pneumatic energy for the inflation of the balloon envelope. To this end, the control block comprises a fan driven in rotation by an electric motor. For more details, reference can, for example, be made to the lighting balloon described in the applicant's patent FR-B1-2 754 040.

Such a lighting balloon has the drawback of requiring continuous operation of the fan and of the associated motor to maintain the interior of the envelope at a substantially constant pressure and keep the balloon inflated.

Moreover, after the power supply to the light bulbs has been cut and the envelope deflated, if the balloon remains subject to outdoor conditions, notably wind, the envelope tends to rub against the pole as a support for the balloon. This can cause damage, even tear the envelope. It is then necessary to repair the envelope before the lighting balloon can once again be used.

The present invention aims to remedy these drawbacks.

More particularly, the present invention aims to provide a lighting balloon of simple design, that can be used outdoors, that is easy to manufacture and assemble.

The present invention also aims to provide a lighting balloon with low energy consumption.

The present invention further aims to provide a lighting balloon that can be stored within a small bulk and that is easy to mount.

In one embodiment, a lighting balloon comprises a deformable envelope, at least one lighting means mounted inside the envelope, and a means for supporting and tensioning the envelope provided with a plate supporting the lighting means and a spacing element mounted on the plate and extending longitudinally or axially. The support and tensioning means cooperates with a top and a base of the envelope to tension said envelope in the longitudinal or axial direction. The balloon comprises at least one shape maintaining means fastened to the envelope and arranged transversely relative to the spacing element. The shape maintaining means is elastic so as to be able to be folded when the envelope is separated from the support and tensioning means and to be deployed automatically in the transversal direction when the envelope is unfolded.

Advantageously, the plate and the spacing element cooperate respectively with the base and the top of the envelope to tension said envelope.

Preferably, the shape maintaining means surrounds the support and tensioning means while remaining at a distance from said means.

The shape maintaining means is preferably coaxial to the spacing element.

In one embodiment, the shape maintaining means has a generally annular shape.

The envelope can be produced from a flexible plastic material and the spacing element from a rigid material.

In one embodiment, the balloon comprises means for fastening or positioning the top of the envelope onto the spacing element.

Advantageously, the base of the envelope comprises an opening having, in the free state, a dimension greater than or equal to the footprint in the transversal direction of the plate and of the lighting means.

The base of the envelope may take, when said envelope is not tensioned in the longitudinal direction, the form of a tubular skirt extending longitudinally downward and delimiting the opening. The base of the envelope may comprise means for clamping said base onto the plate.

In one embodiment, the support and tensioning means comprises a securing foot protruding outward relative to the plate on the side opposite to the lighting means and provided to co-operate with a pole supporting the lighting balloon.

In one embodiment, the spacing element comprises a mast. Alternatively, the spacing element comprises a protection cage provided with a plurality of longitudinal rods delimiting a housing for the lighting means.

In one embodiment, the envelope has, in the tensioned state, a generally tubular shape.

Figure 2:
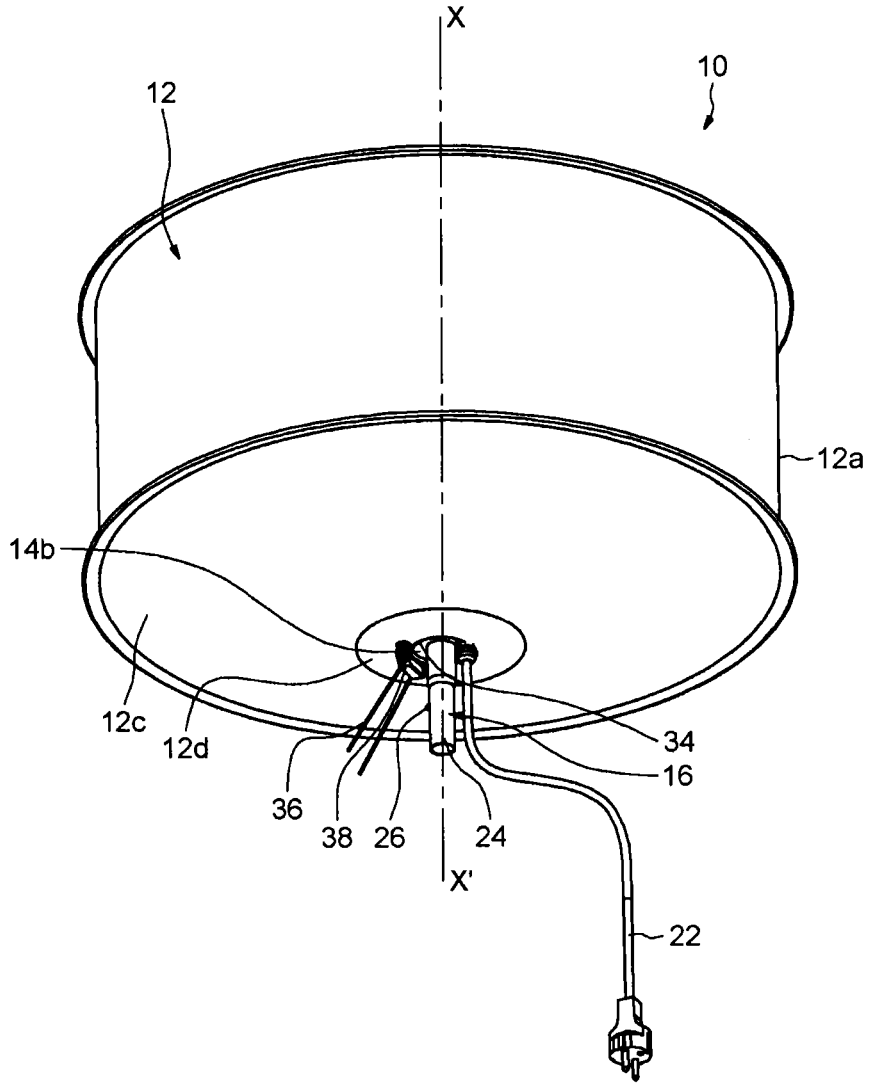
Figure 3:
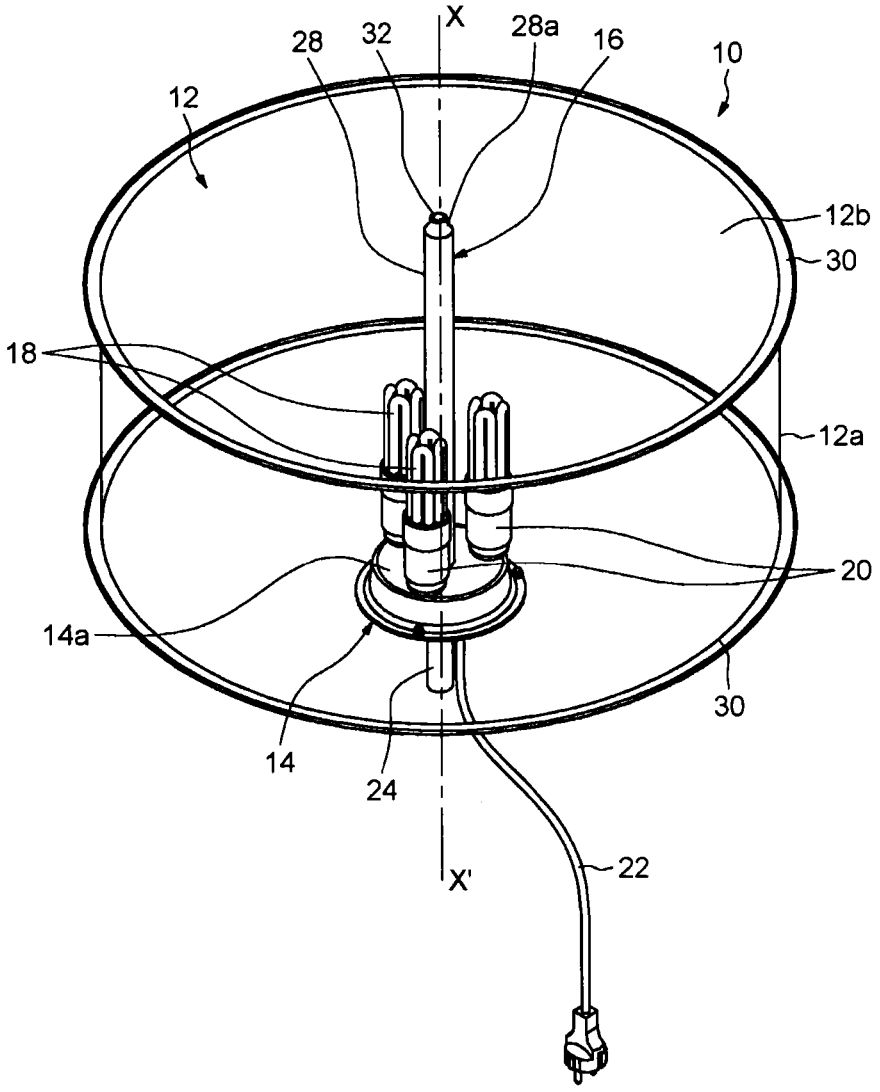
Figure 4:
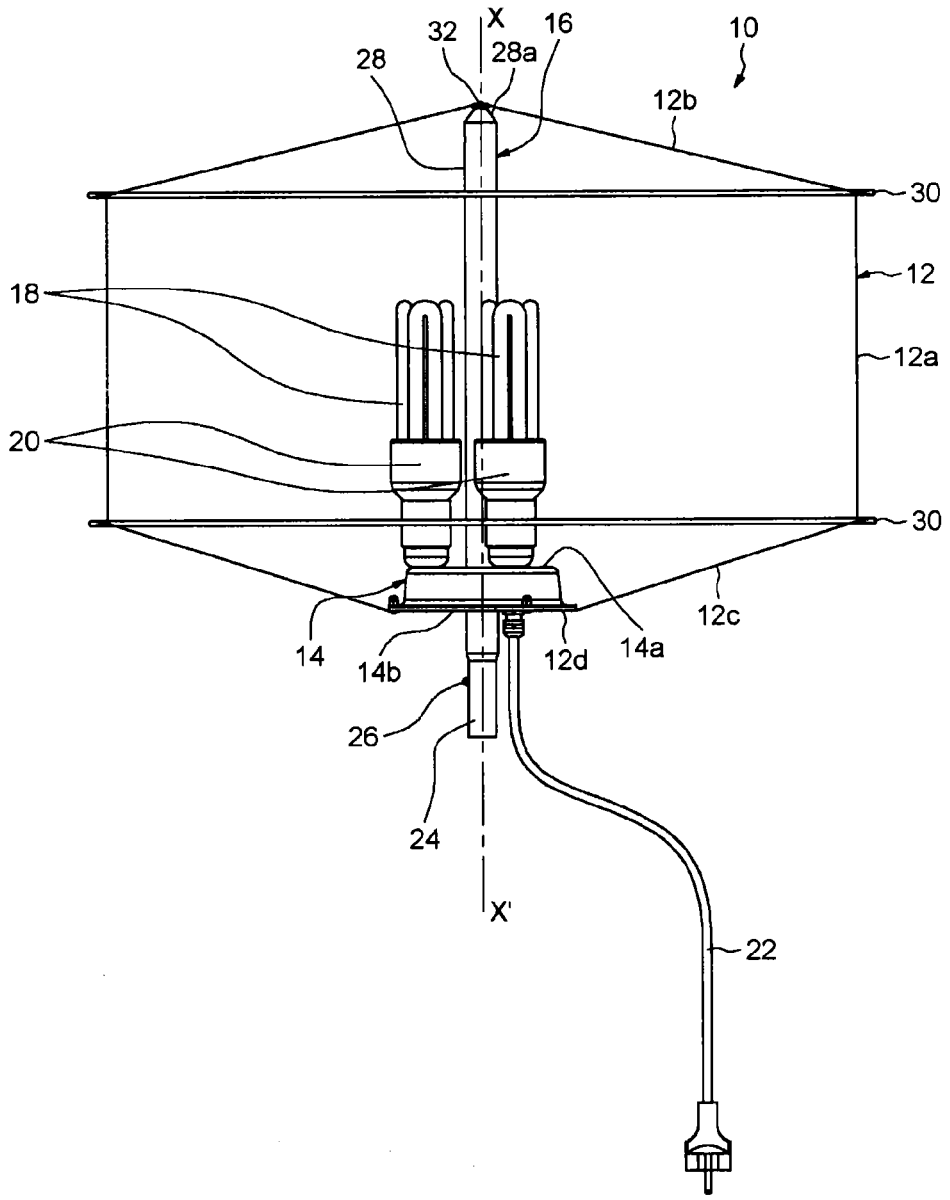
Figure 5:
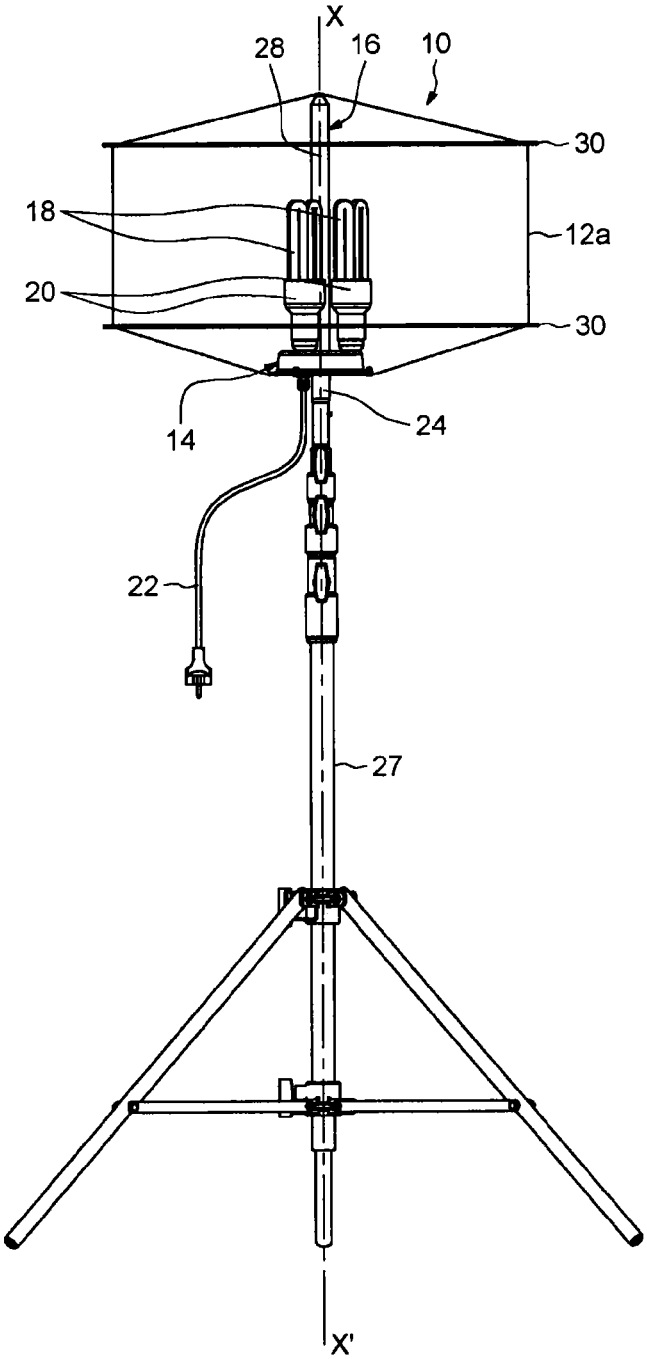
Figure 6:
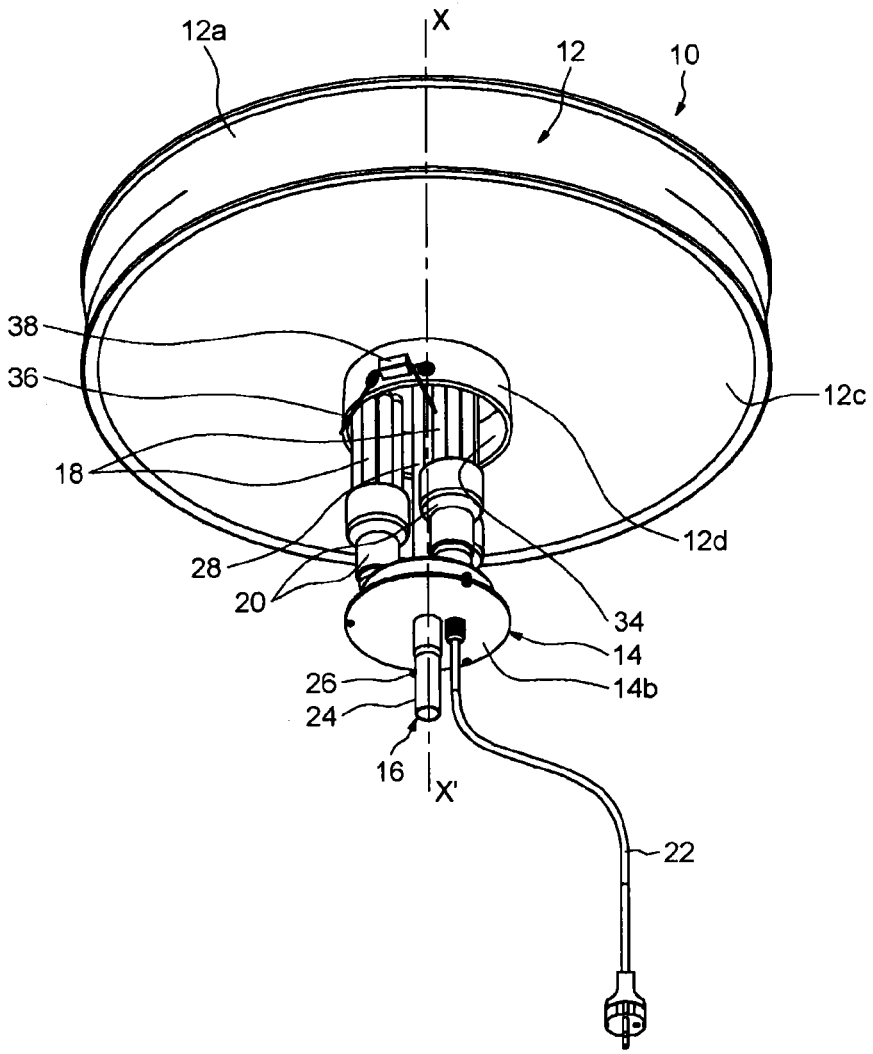
Figure 7:
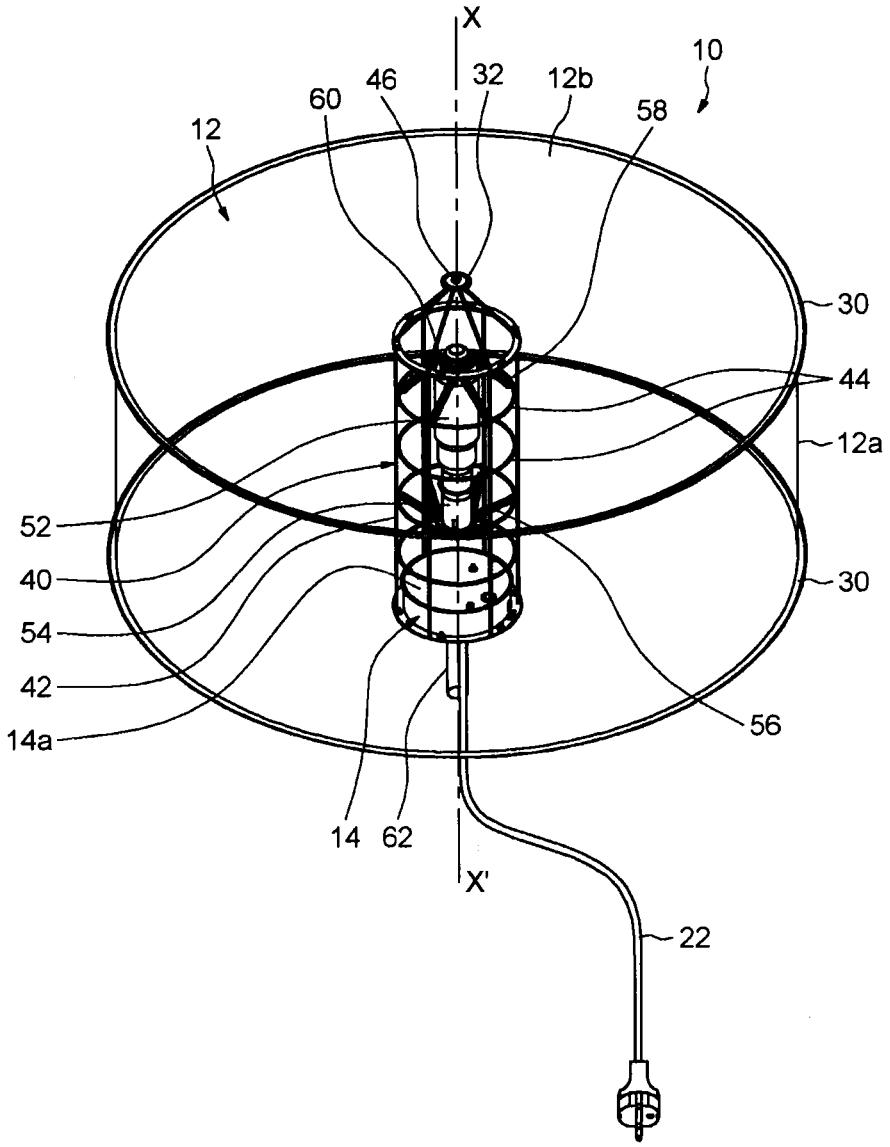
Figure 8:
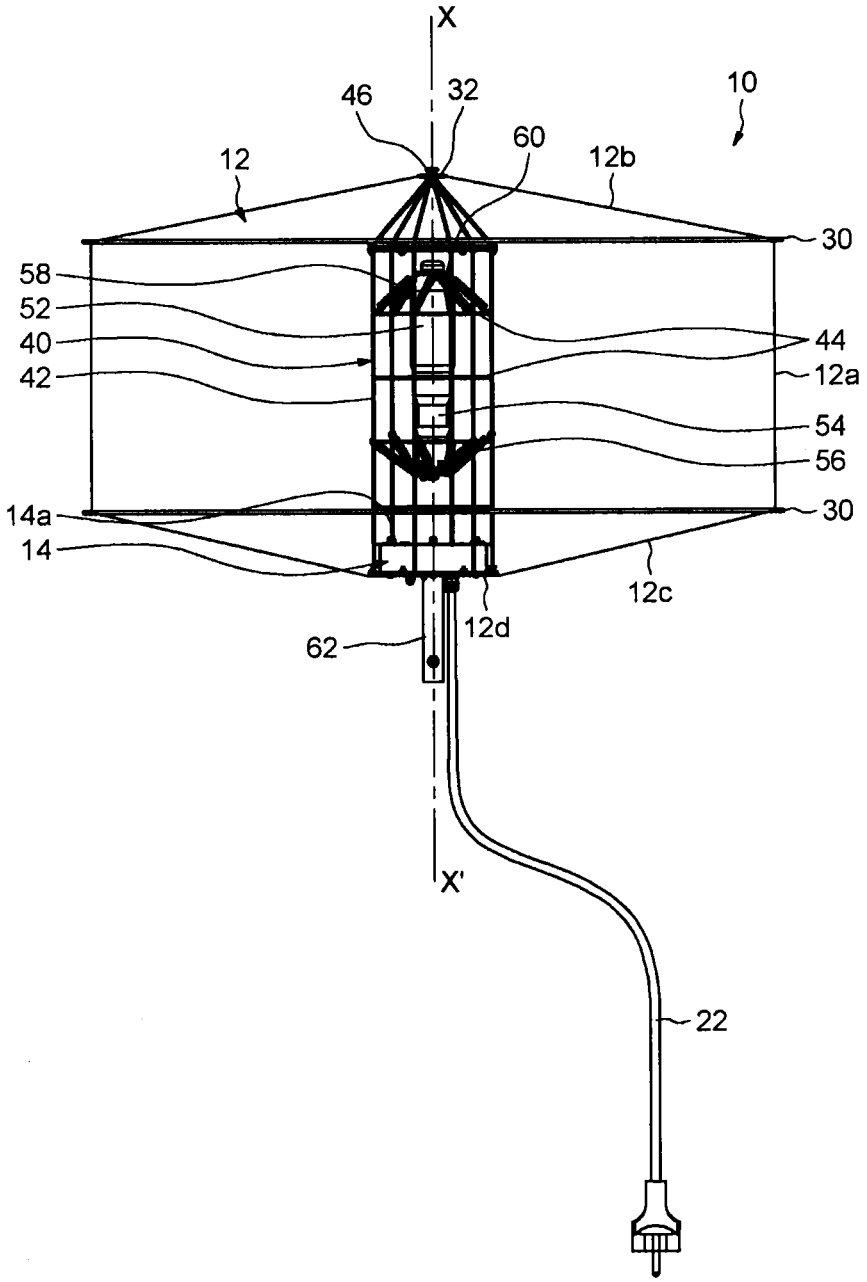
Figure 9:
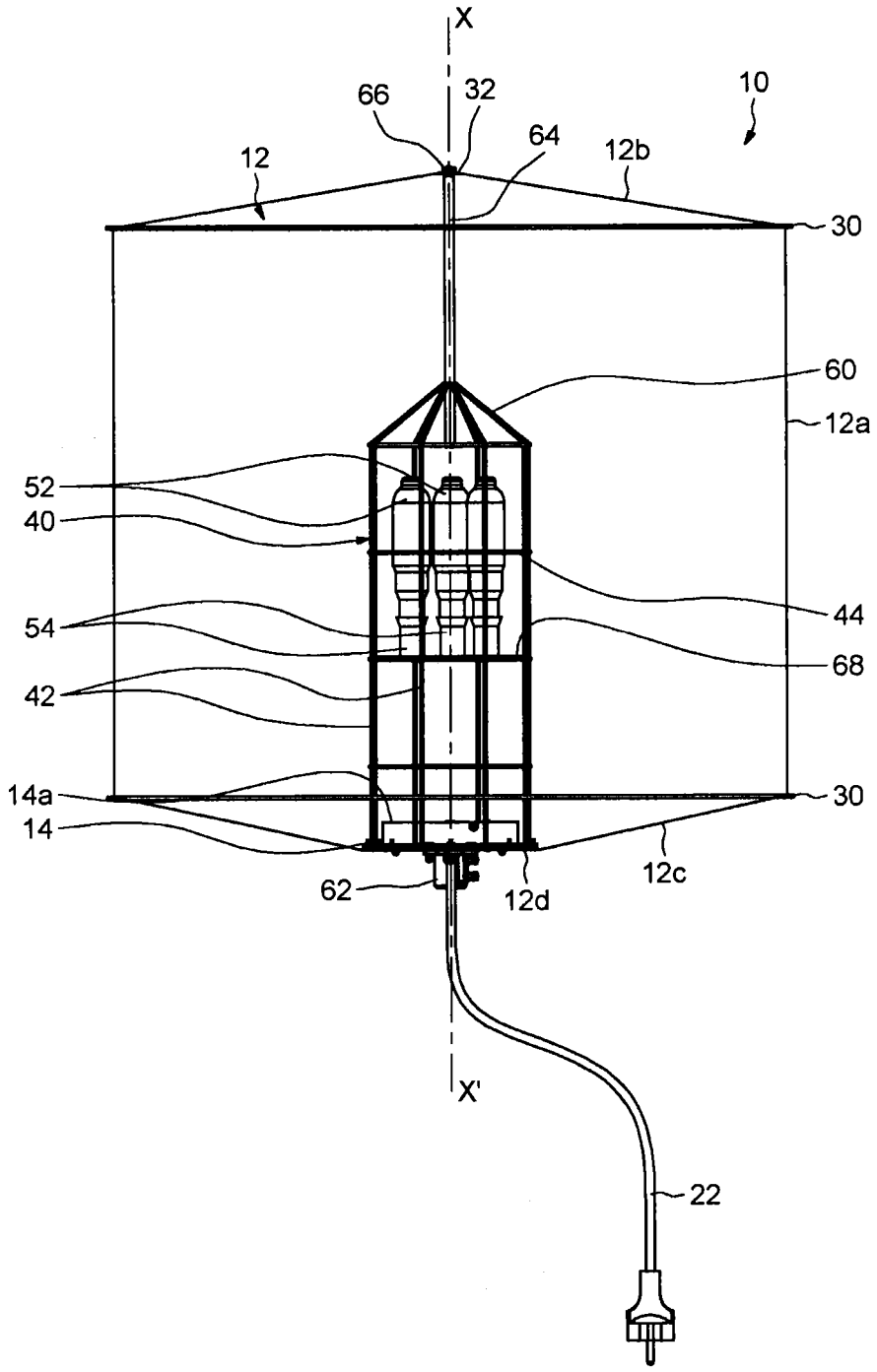

The present invention will be better understood on studying the detailed description of embodiments taken as nonlimiting examples and illustrated by the appended drawings, in which:

FIGS. 1 to 3 are perspective views of a lighting balloon according to a first exemplary embodiment of the invention, FIG. 4 is a front view of the balloon of FIGS. 1 to 3, FIG. 5 is a front view of the balloon of FIGS. 1 to 3 mounted on a support pole, FIG. 6 is a perspective view illustrating a step of assembly of the balloon of FIGS. 1 to 3, FIGS. 7 and 8 are respectively perspective and front views of a lighting balloon according to a second exemplary embodiment of the invention, and FIG. 9 is a front view of a lighting balloon according to a third embodiment of the invention.

In FIGS. 1 to 5 a lighting balloon 10 is represented comprising a deformable enclosure or envelope 12 produced based on a flexible plastic material, for example a polyester, or a textile and which can be transparent or translucent. In FIGS. 3 to 5, the envelope 12 is represented as transparent for reasons of comprehension. The lighting balloon 10 is represented in an assumed vertical position.

As illustrated in particular in FIGS. 3 and 4, the balloon 10 comprises a support plate 14, a mast 16 mounted on said plate and extending along a longitudinal axis X-X', and electric light bulbs 18 fastened to the plate 14 via positioning sockets 20.

The plate 14 has a generally cylindrical shape and comprises, internally, electrical link wires for electrically connecting the sockets 20 to a power supply cable 22. The cable 22 is used to connect the balloon 10 to a current outlet or to a generator set. The plate 14 may comprise an electronic circuit linked to the power supply cable 22 and a temperature detection means such that the electronic circuit can interrupt the electrical power supply to the light bulbs 18 when the temperature detected inside the envelope 12 exceeds a predetermined threshold.

The sockets 20 are fastened onto a planar top surface 14*a* of the plate 14. In the exemplary embodiment illustrated, there are three sockets 20 evenly spaced apart from one another in the circumferential direction. The light bulbs 18 borne by the plate 14 can, for example, be of the incandescent or halogen type and be of high electrical power, for example 1000 W. Obviously, any other type of light source can be used. The light bulbs 18 are oriented in such a way that their axis of elongation is substantially parallel to the axis X-X' of the mast 16. The footprint in the transversal direction of the light bulbs 20 and of the sockets 18 remains circumscribed within the footprint of the plate 14.

As will be described in more detail hereinbelow, a planar bottom surface 14*b* of the plate 14 forms a bearing surface for the envelope 12. The top 14*a* and bottom 14*b* surfaces extend transversely relative to the longitudinal axis X-X' of the mast 16.

The central mast 16 is fastened to the plate 14 and comprises a first foot-forming part 24 protruding downward relative to the bottom surface 14*b* of the plate and outside the envelope 12. The foot 24 comprises ball retaining means 26 which can be inserted by snap-fitting into a pole 27 (FIG. 5) serving as the support for the balloon 10. In the exemplary embodiment illustrated, the pole 27 is a telescopic pole with tripod.

The mast 16 also comprises a second spacing rod-forming part 28 extending longitudinally inside the envelope 12 while protruding upward relative to the top surface 14*a* of the plate. As will be described hereinbelow, the plate 14 and the spacing rod 28 of the mast make it possible to tension the envelope 12 in the longitudinal direction, considering the axis X-X'. The mast 16 is made of a rigid material, for example a metal material such as steel. In the exemplary embodiment illustrated, the foot 24 and the spacing rod 28 are two parts of the mast 16 which is made of a single piece. Alternatively, it could be possible to provide two separate pieces mounted on the plate 14 to form the foot 24 and the rod 28.

The balloon 10 also comprises two securing rings 30 mounted on the envelope 12 and making it possible to confer on the latter its outer shape in the transversal direction. The securing rings 30 are coaxial to the axis X-X' and radially surround the spacing rod 28 of the mast 16 while remaining at a distance therefrom. No direct mechanical link is provided between the mast 16 and the rings 30. The rings 30 are arranged transversely relative to the mast 16 and are spaced longitudinally relative to one another. The rings 30 are mounted in such a way as to be at right angles to the spacing rod 28 of the mast 16. In the exemplary embodiment illustrated, the bottom ring 30 is situated longitudinally at the level of the sockets 20 and the top ring 30 in the vicinity of the top end of the mast 16.

The rings 30 are securely attached to the bottom face of the envelope 12. Pockets (not represented) forming housings for the rings 30 may be stitched onto the internal face of the envelope 12. As a variant, the rings 30 can be fastened to the internal face of the envelope 12 by any other appropriate means, for example by gluing. The rings 30 are advantageously made of an elastic material, for example carbon fibers or glass fibers.

In the embodiment illustrated, the envelope 12 comprises a tubular central part 12*a* delimited longitudinally by the rings 30, tapered top 12*b* and bottom 12*c* end parts, and a base 12*d* extending the bottom end part 12*c* and bearing against the bottom surface 14*b* of the plate 14. The internal surface of the top 12*b* and bottom 12*c* end parts can be covered by a light-reflecting device.

The top of the top end part 12*b* of the envelope comprises an opening 32 into which is introduced the end of a centering spike 28*a* provided at the top end of the spacing rod 28 of the mast 16. The opening 32 may be circled by a metal ring. In the embodiment illustrated, a simple rest in the longitudinal direction is provided between the top of the envelope 12 and the mast 16. As a variant, it could be possible to provide a threading on the spike 28*a* designed to co-operate with a nut so as to ensure the fastening of the top of the envelope 12 onto the mast 16.

To proceed with the assembly of the envelope 12 equipped with the rings 30 on the unitary assembly formed by the plate 14, the light bulbs 18, the sockets 20 and the mast 16, the procedure is as follows. Initially, the top of the envelope 12 is mounted bearing against the top end of the mast 16 by the introduction of the spike 28*a* of the mast into the opening 32 of the envelope.

As illustrated in FIG. 6, at this stage of the assembly, the envelope 12 is not tensioned in the longitudinal direction and the base 12*d* of the envelope is in the form of a tubular skirt extending longitudinally downward and delimiting a cylindrical opening 34. The opening 34 has a dimension greater than the transversal footprint of the plate 14 so as to allow for the passage of the base 12*d* of the skirt-forming envelope around the unitary assembly formed by said plate, the light bulbs 18, the sockets 20 and the mast 16.

Then, a downward pulling force is exerted on the base 12*d* so as to introduce this assembly fully into the envelope 12. Once the base 12*d* of the envelope is situated under the bottom surface 14*b* of the plate, a cord 36 mounted in the thickness of the base 12*d* and extending partly outward so as to be accessible is tightened. The effort exerted on the cord 36 makes it possible to press the base 12*d* against the bottom surface 14*b* of the plate 14 as illustrated in FIG. 2 and ensure that the base 12*d* is immobilized or clamped onto said plate. The cord 36 is provided with an immobilizing means 38 so as to immobilize said cord in position, in the clamped position of the base 12*d* against the plate 14. In the clamped position of the base 12*d*, the diameter of the opening 34 is reduced.

During assembly, the cooperation on the one hand between the top of the envelope 12 and the end of the mast 16, and on the other hand between the base 12*d* of said envelope and the bottom surface 14*b* of the plate 14 allows the envelope 12 to be tensioned in the longitudinal direction. It can be imagined that the longitudinal dimension of the envelope 12 in the tensioned state is determined by the distance separating the bottom surface 14*b* of the plate 14 and the top end of the mast 16. The assembly consisting of the plate 14 and the mast 16 serves a double function, namely ensuring the support of the envelope and tensioning said envelope in the longitudinal direction. After the envelope 12 has been tensioned in the longitudinal direction, the surface of said envelope is smooth, i.e. without folds or bumps. The rings 30 ensure that the shape or the resistance of the envelope 12 is maintained in the transversal direction. The rings 30 form means for reinforcing the envelope 12 in the radial direction. The plate 14, the spacing rod 28 of the mast and the rings 30 constitute the inner structure of the balloon making it possible to rigidify the envelope 12 and keep it in the tensioned state.

The embodiment illustrated in FIGS. 7 and 8, in which identical parts are given identical references, differs mainly from the preceding embodiment in that a cage 40 is mounted instead of the mast. The cage 40 is mounted on the plate 14 by being centered on the axis X-X' and extends longitudinally inside the envelope 12. It comprises a plurality of longitudinal rods 42 extending from the plate 14 and spaced apart from one another regularly in the circumferential direction. The cage 40 also comprises cylindrical reinforcements 44 linking the different rods 42 while being arranged transversely relative thereto. The reinforcements 44 are arranged coaxially to the axis X-X' with a regular spacing. The top ends of the rods 42 are folded down so as to form a tapered top at the end of which extend a centering nipple (not referenced) designed to be introduced into the opening 32 formed at the top of the envelope 12. The end of the nipple is threaded and cooperates with a clamping nut 46 to ensure that the top of the envelope 12 is fastened onto the cage 40.

The rods 42 of the cage 40 internally delimit a cylindrical housing inside which is housed an electric light bulb 52. A socket 54 for positioning the light bulb is supported by the grille 40 via springs 56, here six of them. One end of each spring 56 is fastened to the rods 42 of the grille and the opposite end is fastened to the bottom end of the socket 54. The springs 56 are distributed evenly relative to one another in the circumferential direction. Similarly, a plurality of springs 58 is provided between the grille 40 and a collar 60 added on to the top end of the light bulb 54 to support and maintain said light bulb inside the housing delimited by the protection and spacing grille 40. The plate 14 supports the light bulb 18 via the cage 40. Electrical link wires (not represented) extend between the socket 54 and the plate for the connection to the power supply cable 22. In this embodiment, the plate 14 comprises a foot 62 coaxial to the axis X-X' and protruding downward outside the envelope 12 for the mounting of the balloon on a pole.

The variant embodiment illustrated in FIG. 9, in which identical parts are given identical references, differs from the embodiment described previously in that the cage 40 comprises a rod 64 extending longitudinally and protruding upward relative to the top end of the cage. Thus, the balloon 10 has an increased longitudinal dimension. The rod 64 bears against the edge of the opening 32 of the top of the envelope and internally comprises a threading co-operating with a screw 66 to obtain the fastening of the envelope 12 onto the top end of the rod. In this variant embodiment, three light bulbs 52 are mounted inside the cage 40. The positioning sockets 54 associated with the light bulbs are fastened on to a base 68 added on to one of the reinforcements 44 of the cage substantially at mid-height of said cage.

By virtue of the invention, a lighting balloon is obtained that is provided with a means for supporting and tensioning the envelope to tension said envelope in the longitudinal direction and at least one shape maintaining means mounted on the envelope and arranged transversely relative to said means. This makes it possible to construct a structure for rigidifying the envelope that makes it possible to ensure the shaping and tensioning of the envelope without the need to use a fan and an associated electric motor. The structure of the lighting balloon is simplified.

Moreover, the elastic nature of the shape maintaining rings is particularly advantageous in as much as these rings can be twisted and folded when the envelope is separated from the support and tensioning means for storage purposes. Furthermore, when the envelope is unfolded, its deployment in the transversal direction is obtained automatically. The flexible securing rings securely attached to the envelope make it possible on the one hand for the envelope to be folded down into a small bulk and, on the other hand, through the resumption of their initial shape, a deployment in the transversal direction thereof, by simply releasing the formation constraints applied to the rings. The securing rings are flexible and exhibit elastic return.

In all the embodiments described, each lighting balloon comprises two shape maintaining rings. It is obviously possible to provide a balloon comprising a different number of rings, for example a single ring or even three rings or more. As a variant, it could also be possible to provide shape maintaining means having other configurations, for example elliptical, polygonal such as square, rectangular, hexagonal, octagonal, etc.

The invention claimed is:

1. A lighting balloon comprising:

a deformable envelope, at least one lighting means mounted inside the envelope, a means for supporting and tensioning the envelope provided with a plate supporting the lighting means and a spacing element mounted on the plate and extending longitudinally, said support and tensioning means cooperating with a top and a base of the envelope to tension said envelope in the longitudinal direction, and at least one shape maintaining means fastened to the envelope and arranged transversely relative to the spacing element to maintain the shape of said envelope in the transversal direction, wherein the plate, the spacing element and the shape maintaining means constitute an inner structure of the lighting balloon, wherein the shape maintaining means is elastic so as to be able to be folded when the envelope is separated from the support and tensioning means and to be deployed automatically in the transversal direction when the envelope is unfolded, no direct mechanical link being provided between the spacing element and the shape maintaining means.

2. The balloon as claimed in claim 1, wherein the plate and the spacing element cooperate respectively with the base and the top of the envelope to tension said envelope.

3. The balloon as claimed in claim 1, wherein the shape maintaining means surrounds the support and tensioning means while remaining at a distance from said means.

4. The balloon as claimed in claim 1, wherein the shape maintaining means is coaxial to the spacing element.

5. The balloon as claimed in claim 1, wherein the shape maintaining means has a generally annular shape.

6. The balloon as claimed in claim 1, wherein the envelope is produced from a flexible plastic material and the spacing element is produced from a rigid material.

7. The balloon as claimed claim 1, comprising means for fastening the top of the envelope onto the spacing element.

8. The balloon as claimed in claim 1, wherein the base of the envelope comprises an opening having, in the free state, a dimension greater than the footprint in the transversal direction of the plate and of the lighting means.

9. The balloon as claimed in claim 8, wherein the base of the envelope takes, when said envelope is not tensioned in the longitudinal direction, the form of a tubular skirt extending longitudinally downward and delimiting the opening.

10. The balloon as claimed in claim 8, wherein the base of the envelope comprises means for clamping said base onto the plate.

11. The balloon as claimed in claim 1, wherein the support and tensioning means comprises a securing foot protruding outward relative to the plate on the side opposite to the lighting means and provided to cooperate with a pole supporting the lighting balloon.

12. The balloon as claimed in claim 1, wherein the spacing element comprises a mast.

13. The balloon as claimed in claim 1, wherein the spacing element comprises a protection cage provided with a plurality of longitudinal rods delimiting a housing for the lighting means.

14. The balloon as claimed in claim 1, wherein the envelope has, in the tensioned state, a generally tubular shape.

* * * * *